US007043794B2

(12) United States Patent
Conner et al.

(10) Patent No.: US 7,043,794 B2
(45) Date of Patent: May 16, 2006

(54) SELF-PROPELLED VACUUM CLEANER WITH A NEUTRAL RETURN SPRING

(75) Inventors: Michael P. Conner, Uniontown, OH (US); Robert A. Vystrcil, Garrettsville, OH (US); Steven J. Paliobeis, Painesville, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 478 days.

(21) Appl. No.: 10/339,749

(22) Filed: Jan. 9, 2003

(65) Prior Publication Data

US 2004/0134020 A1 Jul. 15, 2004

(51) Int. Cl.
*A47L 5/00* (2006.01)
*A47I 9/32* (2006.01)

(52) U.S. Cl. ..... 15/340.2; 15/339; 15/412

(58) Field of Classification Search ..... 15/319, 15/339, 340.2, 350–353, 412, DIG. 10
See application file for complete search history.

(56) References Cited

U.S. PATENT DOCUMENTS

| | | | | |
|---|---|---|---|---|
| 1,356,663 | A | 10/1920 | Spielman | |
| 1,447,814 | A | 3/1923 | Paulus | |
| 1,459,946 | A | 6/1923 | Camarata et al. | |
| 1,465,285 | A | 8/1923 | Peterson | |
| 2,619,209 | A | 11/1952 | Horn | |
| 2,814,063 | A | 11/1957 | Ripple | |
| 2,950,772 | A | 8/1960 | Dostal et al. | |
| 3,218,876 | A | 11/1965 | Berger | |
| 3,220,043 | A | 11/1965 | Lampe | |
| 3,451,495 | A | 6/1969 | Bayless et al. | |
| 3,581,591 | A | 6/1971 | Ziegler et al. | |
| 3,618,687 | A | 11/1971 | Ripple et al. | |
| 3,823,791 | A | 7/1974 | Sheler | |
| 3,854,164 | A | 12/1974 | Schmitz | |
| 3,896,892 | A | 7/1975 | Kohls et al. | |
| 3,938,216 | A * | 2/1976 | Schmitz et al. | 15/340.2 |
| 3,942,604 | A | 3/1976 | Black III | |
| 4,052,767 | A | 10/1977 | Dutcher | |
| 4,111,372 | A | 9/1978 | Hicks et al. | |
| 4,249,281 | A | 2/1981 | Meyer et al. | |
| 4,342,369 | A | 8/1982 | Ransom | |
| 4,347,643 | A | 9/1982 | Bair, III | |
| 4,434,865 | A | 3/1984 | Tschudy et al. | |
| 4,615,071 | A | 10/1986 | Frohbieter | |
| 4,624,027 | A | 11/1986 | Martin | |
| 4,766,640 | A | 8/1988 | Martin et al. | |
| 5,056,175 | A | 10/1991 | Stein et al. | |
| 5,077,823 | A | 12/1991 | Barry et al. | |

(Continued)

*Primary Examiner*—Terrence R. Till
(74) *Attorney, Agent, or Firm*—Fay, Sharpe, Fagan, Minnich & McKee, LLP

(57) ABSTRACT

A self-propelled vacuum cleaner includes a base having a suction inlet. An upright housing is pivotally mounted to the base. A suction source is disposed in one of the base and the upright housing to generate an airflow at the suction inlet. A dust collection chamber is mounted to one of the base and the upright housing and communicates with the suction inlet and the suction source. A drive motor is mounted to the base. A driven wheel is operatively connected to the drive motor. A handle assembly is mounted to the upright housing, wherein the handle assembly includes an upper handle, a handle grip assembly slidably mounted to the upper handle, and a neutral return spring fastened to the upper handle and engaging the handle grip assembly to urge the handle grip assembly to a neutral position.

30 Claims, 8 Drawing Sheets

U.S. PATENT DOCUMENTS 5,115,537 A 5/1992 Meyer et al.
RE34,286 E 6/1993 Toyoshima et al.
5,285,550 A 2/1994 Meyer et al.
5,335,740 A 8/1994 Meyer et al.
5,339,916 A 8/1994 Louis
5,406,674 A 4/1995 Lawter et al.
5,455,886 A 10/1995 Glenn et al.
5,504,971 A 4/1996 McCormick
5,831,261 A 11/1998 Plesko
5,944,635 A 8/1999 Butler, Jr.
5,974,622 A * 11/1999 Louis et al. ..... 15/340.2
6,061,869 A 5/2000 Ettes et al.
6,102,022 A 8/2000 Schave
6,108,862 A * 8/2000 Frederick et al. ..... 15/340.2
6,169,258 B1 1/2001 Roney et al.
6,449,792 B1 * 9/2002 Myers ..... 15/28
6,741,051 B1 5/2004 Chu
2001/0039691 A1 * 11/2001 Bobrosky et al. ..... 15/339
2002/0170137 A1 * 11/2002 Coates et al. ..... 15/320
2004/0134019 A1 * 7/2004 Cipolla et al. ..... 15/340.2
2004/0135537 A1 * 7/2004 Conner et al. ..... 318/701
2005/0071056 A1 3/2005 Tondra et al.

* cited by examiner

SELF-PROPELLED VACUUM CLEANER WITH A NEUTRAL RETURN SPRING

BACKGROUND OF THE INVENTION

The present invention relates to vacuum cleaners. More specifically, the invention relates to self-propelled vacuum cleaners.

Known self-propelled vacuum cleaners include an electric motor disposed in the suction nozzle or base of the cleaner for driving a set of driven wheels. The drive motor exerts a driving force on the driven wheels in a direction of movement of the suction nozzle base desired by the operator. A detector is provided to control the direction that the drive motor will drive the wheels. One known detector located in the handle of the vacuum cleaner includes a switch having three positions to control the direction of rotation of the motor. If an operator pushes the vacuum cleaner forward, the switch is forced into a first end position under the influence of the friction between the switch and the surface to be cleaned. With the switch in the first end position, the motor drives the driven wheels with a substantially constant speed in a forward direction. If the operator pulls the vacuum cleaner backward, the switch is forced into a second end position under the influence of the friction. In the second end position the motor drives the driven wheels with a substantially constant speed in a backward direction. If the user keeps the suction nozzle stationary, the switch is displaced to an intermediate position disposed between the two end positions, where the drive motor does not rotate.

The known detector includes helical springs to urge the detector into the intermediate or neutral position after the user has stopped pushing or pulling on the handle of the vacuum cleaner. The use of such helical springs has resulted in problems including overshoot of the neutral position, high acceleration when the force is applied or removed, and ringing of the components inside the handle. Ringing can result from the helical spring vibrating in a direction perpendicular to its longitudinal axis resulting in the spring contacting its housing, i.e. the handle. This vibration can result from movement of the motors in the vacuum cleaner transferring forces to the handle.

Furthermore, the use of a spring in a system of connected bodies of results in periodic motion. In a vacuum cleaner having a spring that urges a detector into a neutral position after the user has stopped pushing or pulling on the handle, a spring not exhibiting proper damping characteristics may result in "overshoot" after the force, which is supplied by the operator, has been removed. The portion of the handle that is connected to the spring will attain a velocity such that the spring will move out of equilibrium. Since the motor is in neutral only when the spring is in equilibrium, when the spring "overshoots" equilibrium the sensor delivers a message to the motor to drive in the opposite direction from the direction the motor was just driving in. Such overshoot can result in jarring at the motor and in the vacuum cleaner as a whole.

Accordingly, it is desirable to provide a mechanism to urge the drive control mechanism into a neutral position while eliminating the above-mentioned problems exhibited in the prior art.

SUMMARY OF THE INVENTION

According to the present invention, a new and improved self-propelled vacuum cleaner is provided. In accordance with one aspect of the invention, a self-propelled vacuum cleaner includes a base having a suction inlet. An upright housing is pivotally mounted to the base. A suction source is disposed in one of the base and the upright housing to generate an airflow at the suction inlet. A dust collection chamber is mounted to one of the base and the upright housing and communicates with the suction inlet and the suction source. A drive motor is mounted to one of the base and the upright housing. A driven wheel is operatively connected to the drive motor. A handle assembly is mounted to the upright housing, wherein the handle assembly includes an upper handle, a handle grip assembly slidably mounted to the upper handle, and a neutral return spring fastened to the upper handle and engaging the handle grip assembly to urge the handle grip assembly to a neutral position.

In accordance with another aspect of the invention, a self-propelled vacuum cleaner includes a base having a suction inlet. A handle is pivotally mounted to the base. A suction source is mounted to one of the base and handle to generate an airflow at the suction inlet. A filter chamber is mounted to one of the base and the handle and communicates with the suction inlet and the suction source. The vacuum cleaner further includes a drive motor mounted to one of the base and the handle. A driven wheel is operatively connected to the drive motor. A handle grip is mounted for reciprocation in relation to the handle between a first end position, a neutral center position, and a second opposite end position. A stem extends from the handle grip and includes a projection. A neutral return spring is mounted to the handle and receives at least a portion of the projection. The neutral return spring urges the handle grip to the neutral central position.

In yet another embodiment of the invention a self-propelled vacuum cleaner includes a base having a suction inlet. A handle is pivotally connected to the base. A suction source is mounted to one of the base and the handle to generate an airflow at the suction inlet. A filter chamber is mounted to one of the base and the handle and communicates with the suction inlet and the suction source. The self-propelled vacuum cleaner also includes a drive motor mounted to one of the base and the handle. A driven wheel is operatively connected to the drive motor. A handle grip is slidably mounted on the handle. A handle stem is connected to the handle grip and includes a post. At least a portion of the handle stem is received in the handle. The vacuum cleaner also includes a plate and a fastener for attaching the plate to the handle. An elastomeric biasing member is mounted to the plate and is mounted to handle. The biasing member urges the handle grip toward a neutral position upon displacement of the handle grip in relation to the handle from the neutral position.

The advantages and benefits of the present invention will become apparent to those of ordinary skill in the art upon reading and understanding the following detailed description of the preferred embodiment.

BRIEF DESCRIPTION OF THE DRAWINGS

The drawings are only for purposes of illustrating a preferred embodiment of the invention and are not to be construed as limiting the invention. The invention may take form in various components and arrangement of components, and in various steps and arrangements of steps, a preferred embodiment of which will be illustrated in the accompanying drawings wherein.

DETAILED DESCRIPTION OF THE PREFERRED EMBODIMENT

Figure 1:
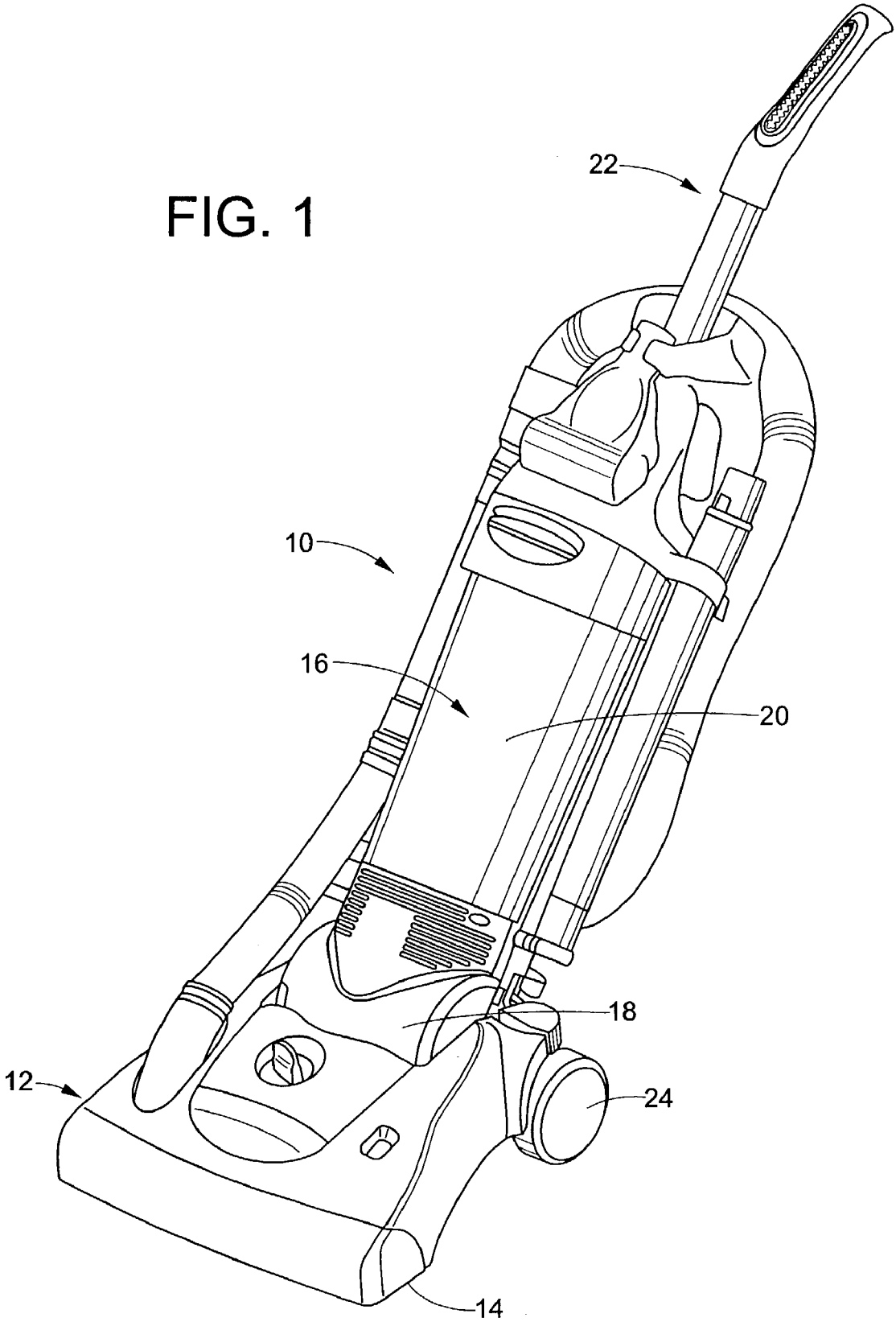
FIG. 1 is a perspective view illustrating a self-propelled upright vacuum cleaner in accordance with the present invention.

Referring now to the figures, wherein the showings are for purposes of illustrating a preferred embodiment of the invention only and not for limiting the same, FIG. 1 illustrates a self-propelled upright vacuum cleaner 10. The upright vacuum cleaner 10 includes a base 12 having a suction inlet 14. An upright housing 16 is pivotally connected to the base 12. A suction source 18, which can include a motor, is disposed in one of the base 12 and the upright housing 16. In FIG. 1, the motor is mounted in a lower portion of the upright housing 16. A filter chamber 20 is mounted to one of the base 12 and the upright housing 16. In FIG. 1, the filter chamber 20 is mounted in the upright housing 16. The suction source 18 communicates through passages (not shown) with the suction inlet 14 to generate an airflow to deliver dirty air from the suction inlet to the filter chamber 20. As is well known, the filter chamber 20 can include a filter assembly (not shown) to filter the dust and dirt from the dirty airstream and a dust container (such as a dust cup or a filter bag) to hold the dust filtered in the chamber for later disposal. One known type of filter chamber is shown in application Ser. No. 10/224,483 which is entitled "Vacuum Cleaner Having Hose Detachable at Nozzle" and which was filed on Aug. 20, 2002, which is owned by the assignee of the present invention. So that a user can maneuver the vacuum cleaner 10, a handle assembly 22 is mounted to the upright housing 20. Also, a pair of rear wheels 24 (only one visible in FIG. 1) support the base 12 above the surface to be cleaned and facilate movement of the base across the surface.

Figure 6:
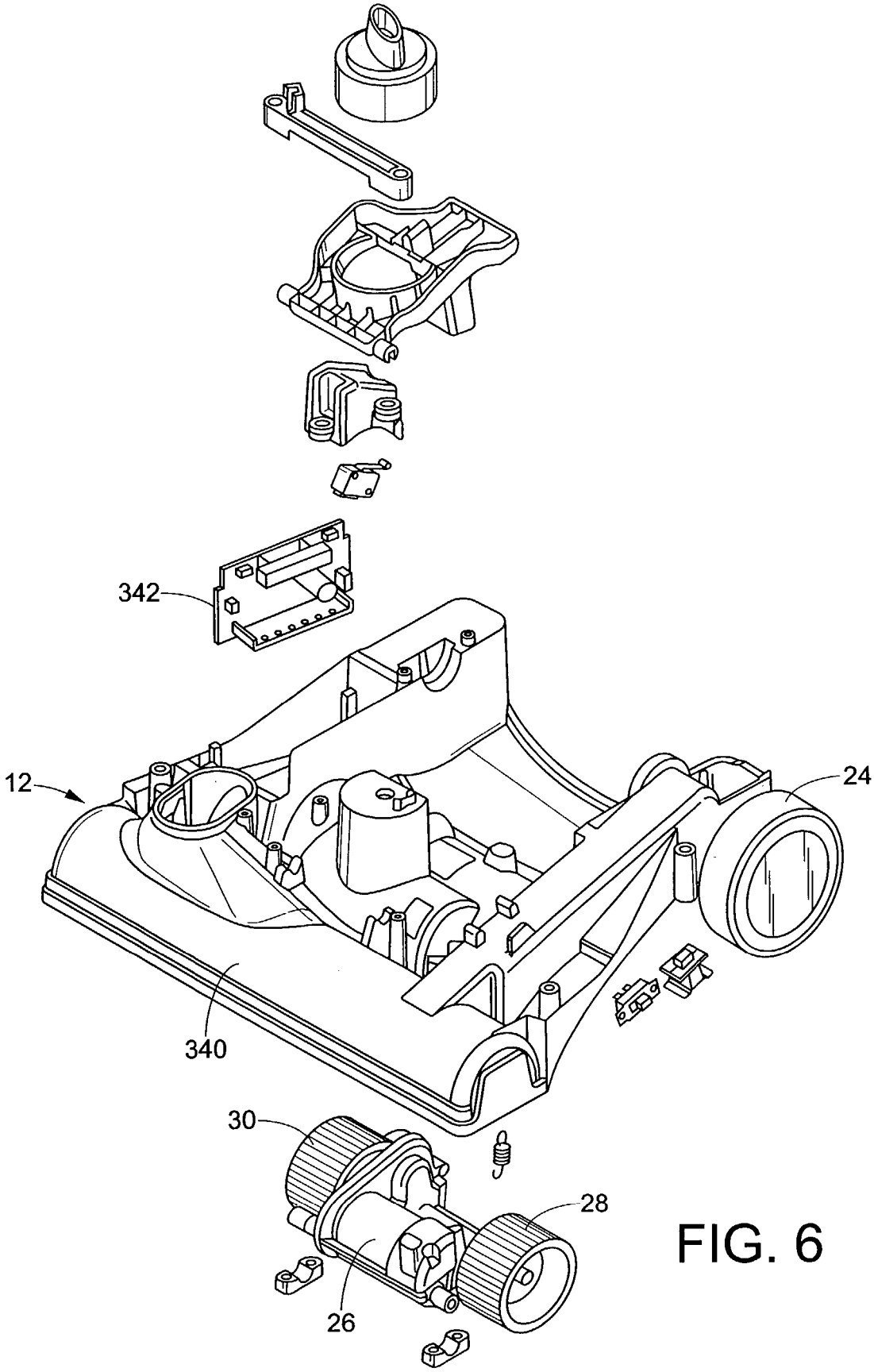
FIG. 6 is an exploded view of a base assembly of the vacuum cleaner of FIG. 1.

With reference now also to FIG. 6, the self-propelled vacuum cleaner 10 also includes a drive motor 26 operatively connected to driven wheels 28 and 30, such that the drive motor drives the wheels to propel the base. The drive motor 26 can be mounted in the base 12 or to the upright housing 16. The drive motor will be described in more detail below. An operator of the vacuum cleaner can control the speed and direction of rotation of the wheels 28 and 30 by manipulating the handle assembly 22. The motor 26 is in communication via circuitry (not shown) with a sensor assembly, which will be described in more detail below, located in the handle assembly 22. As the operator manipulates the handle assembly 22, the motor 26 reacts to propel the base 12 accordingly.

Figure 2:
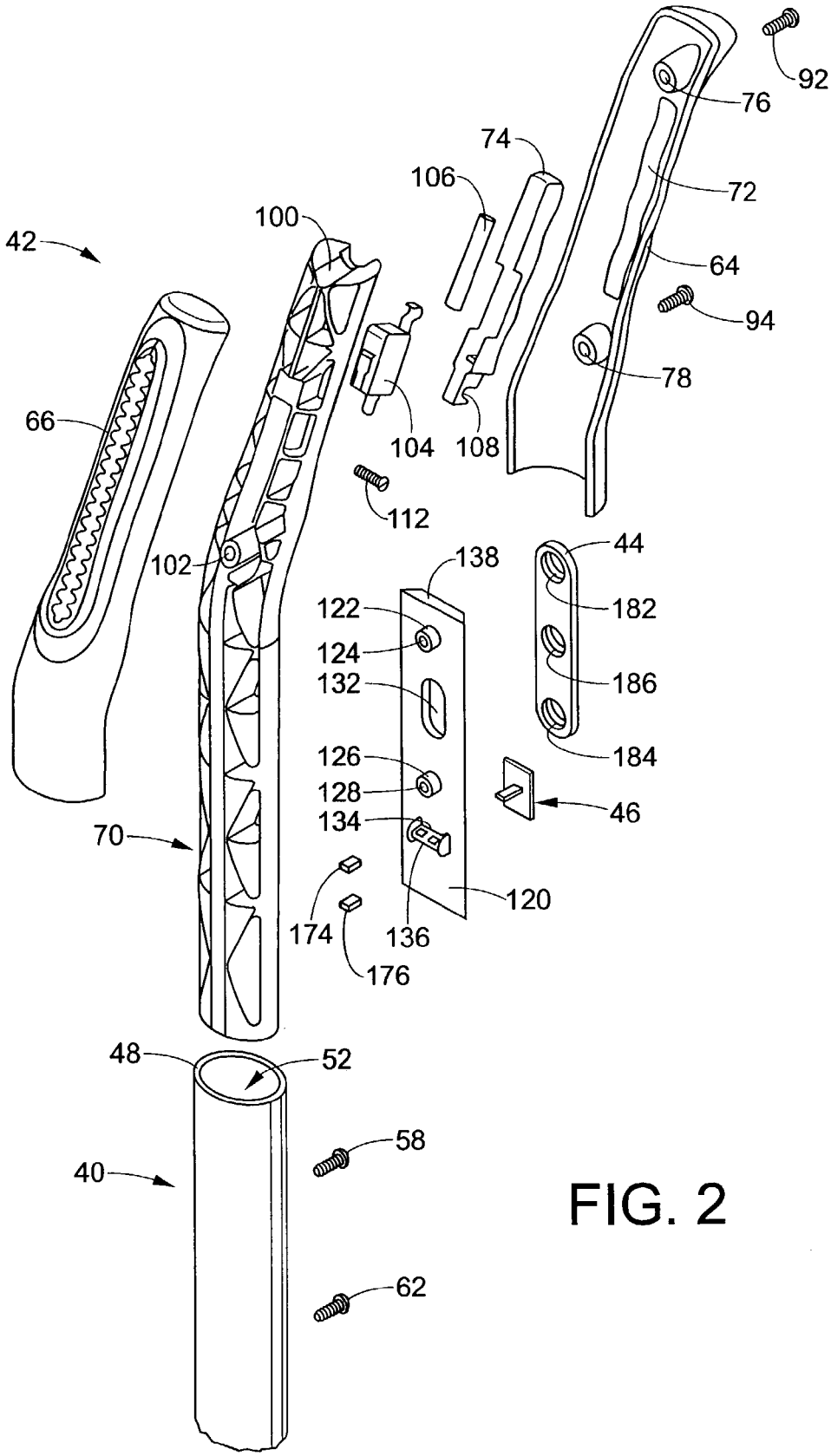
FIG. 2 is an enlarged exploded perspective view of an upper portion of the vacuum cleaner of FIG. 1, including a handle assembly.

Referring now to FIG. 2, the handle assembly 22 includes an upper handle 40, a handle grip assembly 42, a neutral return spring 44, and a sensor assembly 46 that communicates through known electrical circuitry (not shown) to control the speed and direction of rotation of the motor 26.

Figure 3:
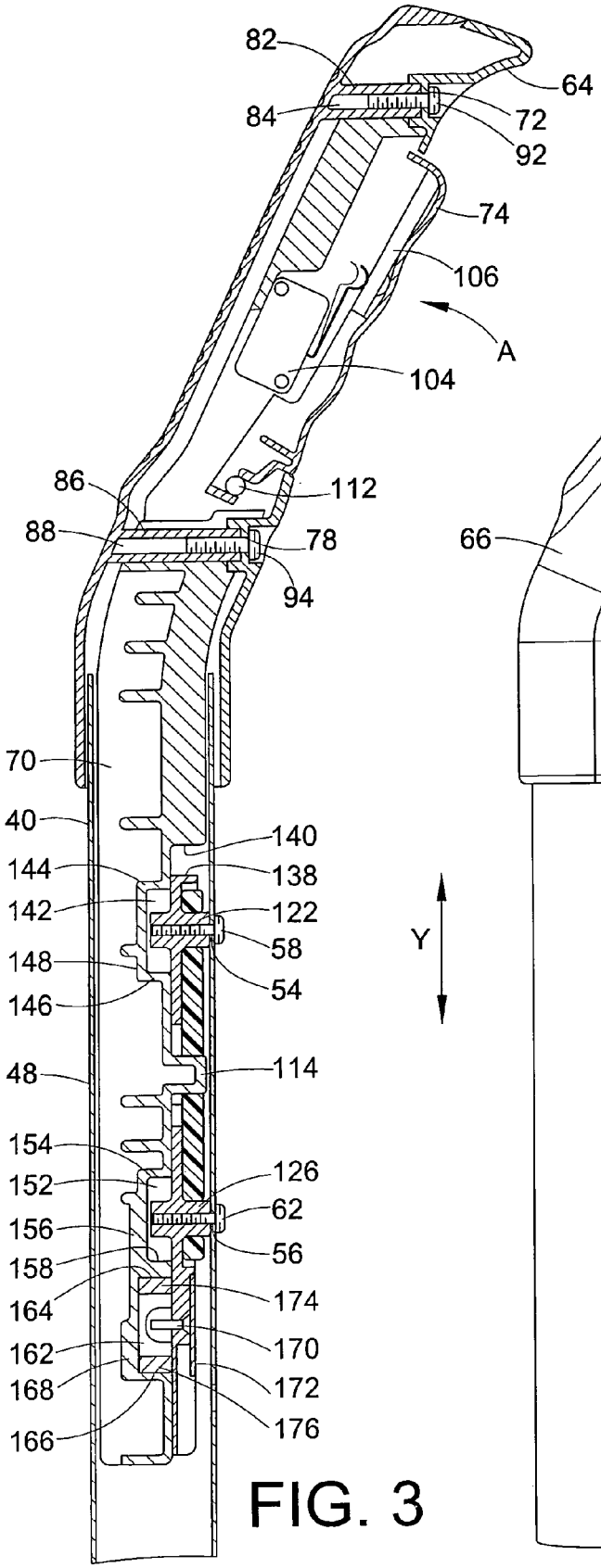
FIG. 3 is an assembled side cross-sectional elevation view of the handle assembly of FIG. 2.

The upper handle 40 is tubular in nature and includes an external wall 48 that defines an interior bore 52. The upper handle bore 52 receives a portion of the handle grip assembly 42 along with the neutral return spring 44 and the sensor assembly 46. The upper handle 40 is preferably made from conventional materials such as molded plastics, metal and the like. With reference now to FIG. 3, the external wall 48 of the upper handle 40 includes an upper opening 54 and a lower opening 56. The openings 54 and 56 receive conventional fasteners 58 and 62, the importance of which will be described below.

With reference again to FIG. 2, the handle grip assembly 42 includes a handle grip bottom half 64 that attaches to a handle grip top half 66 to form a clamshell type handle grip 68. The handle grip is fastened to a frame or stem. The handle grip bottom half 64 includes a slot 72 through which a switch trigger 74 is received. Also, the handle grip bottom half 64 includes an upper opening 76, defined in a boss positioned above the slot 72, and a lower opening 78, defined in a boss positioned below the slot.

Figure 4:
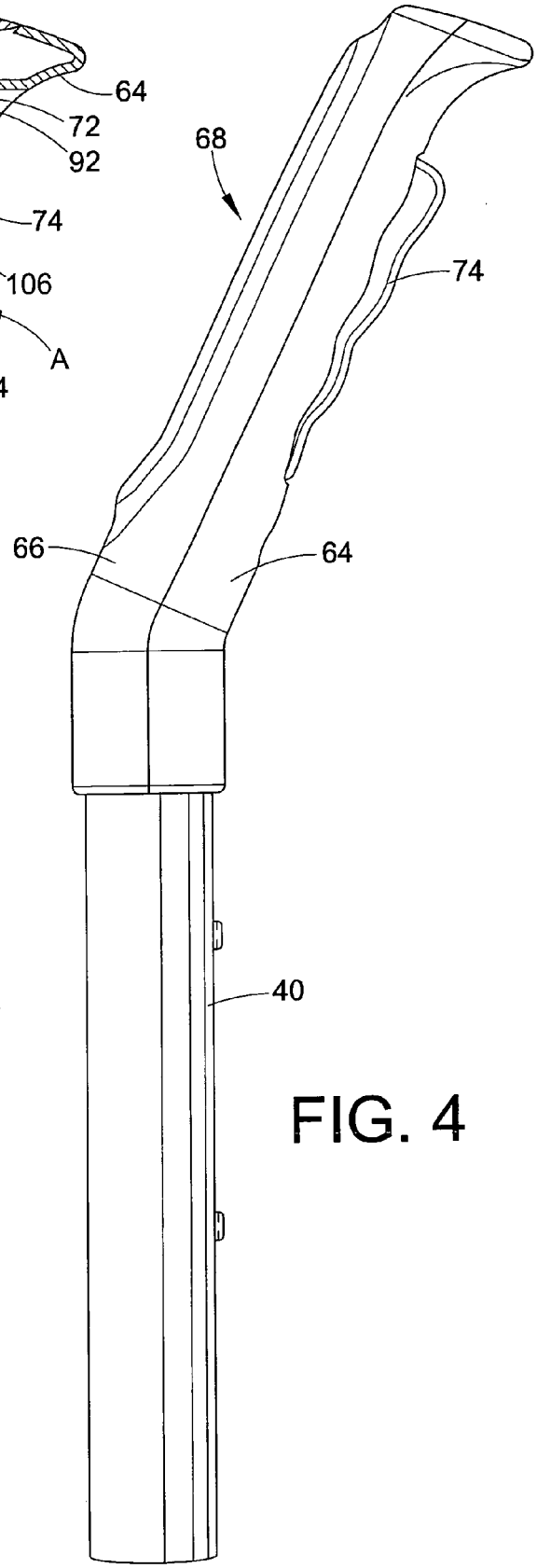
FIG. 4 is a side view of the handle assembly of FIG. 3.

With reference again to FIG. 3, the handle grip top half 66 includes an upper projection 82 having an opening 84 aligned with the upper opening 76 in the handle grip bottom half 64. The handle grip top half 66 also includes a lower projection 86 having an opening 88 aligned with the lower opening 78 in the handle grip bottom half 64. Extending through the aligned openings 76 and 84 is a conventional fastener 92 to attach the handle grip top half 66 to the handle grip bottom half 68 in a clamshell configuration. Similarly, the aligned openings 88 and 78 receive a conventional fastener 94 to attach the handle grip top half 66 to the handle grip bottom half 68. As seen in FIG. 4, the handle grip top and bottom halves 64 and 66 mount around an upper portion of the upper handle 40 so that the handle grip 68 can slide along the upper handle 40. Although the handle grip assembly 42 has been described as comprising three separate pieces in this embodiment, it can, of course, comprise a unitary structure, two or a plurality of pieces, as is appreciated by one of skill in the art.

As noted above, the handle grip stem 70 is sandwiched between and fastened to the handle grip bottom and top halves 64 and 66. As is evident from FIG. 2, the handle grip stem 70 includes an upper notch 100 which is aligned with the upper boss of the handle grip bottom half 64 and the projection 82 of the handle grip top half 66. The handle grip stem 70 also includes a lower opening 102 aligned with the lower boss in the handle grip bottom half 64 the lower projection 86 in the handle grip top half 66 to receive the lower projection.

A switch 104 is interposed between the handle grip stem 70 and the trigger 74. The switch 104 is electronically connected via circuitry (not shown) to a power cord (not shown) that can connect to an external power source and to the suction source 18 and the drive motor 26. A switch return 106 is positioned between the switch 104 and the trigger 74. The trigger 74 includes a notch 108 at its end towards the base 12 that receives a pin 112. The pin 112 is received in the handle grip stem 70. To activate the switch 104, and thus provide power to the drive motor 26, the operator depresses the trigger 74, as depicted by arrow A in FIG. 3. The trigger pivots about the pin 112 to engage the switch 104. Although a desired configuration for a switch has been described, alternate known switches are also encompassed by the invention, including, but not limited to, a simple pivot switch, a slide switch and the like.

Referring back to the handle grip stem 70, a portion of it is received in the bore 52 of the upper handle 40. As is apparent from FIG. 3, the operator of the vacuum cleaner 10 can slide the handle grip 68 and the handle grip stem 70 up and down as a unitary structure in relation to the upper handle 40 as depicted by arrow Y. The handle grip stem 70 includes a projection or post 114 that engages the neutral return spring 44. As the operator pushes downward on the handle grip 68, the handle grip stem 70 and the post 114 move downward. The neutral return spring 44 urges the post 114 upward toward a neutral position when the operator stops pushing down on the handle grip. Likewise, as the operator pulls the handle grip 68 upward, the handle grip stem 70 and the post 114 move upward. The neutral return spring 44 urges the post downward back toward the neutral position when the operator ceases pulling upward.

As shown in FIG. 2, a plate 120 is interposed between the handle grip stem 70 and the neutral return spring 44. The plate includes an upper boss 122 having an aperture 124 and a lower boss 126 having a lower aperture 128. As seen in the FIG. 3, each of the projections 122 and 126 extend through the plate 120 substantially normal to the plane of the plate. The upper aperture 124 aligns with the upper opening 54 in the upper handle 40 to receive the fastener 58 to attach the plate 120 to the upper handle. The lower aperture 128 aligns with the lower opening 56 of the upper handle 40 to receive the fastener 62 to attach the plate 120 to the upper handle. The plate 120 also includes a slot 132 located between the upper boss 122 and the lower boss 126. The slot 132 has a width large enough to receive the post 114 of the handle grip stem 70 while limiting the lateral movement of the post. Also, the slot 132 has a length that allows the post 114 to move along the length of the slot, substantially parallel to the arrow Y. The plate 120 also includes a sensor opening 134 dimensioned to receive a portion of the sensor assembly 46. The plate also includes a cantilever 136 to support the portion of the sensor assembly 46; the sensor assembly will be described in more detail below. The plate 120 also includes a top wall 138.

The invention also contemplates not including the plate 120. For example, the neutral spring 44 and the sensor assembly 46 can be mounted directly to the external wall 48 of the upper handle 40. Furthermore, the plate 120 can be positioned elsewhere. One such example would be interposing the plate between the neutral return spring 44 and the external wall 48.

With continued reference to FIG. 3, the handle grip stem 70 includes a stop wall 140 adjacent the top wall 138 of the plate 120. The stop wall 140 limits the downward movement of the handle grip stem 70 in relation to the upper handle 40. The handle grip stem 70 also includes an upper notch 142 having an upper wall 144, a lower wall 146 and a base wall 148 connecting the upper wall to the lower wall. The upper wall 144 and the lower wall 146 can contact the upper boss 122 on the plate 120 to limit the vertical movement of the handle grip stem 70. The handle grip stem also includes a lower notch 152 having an upper wall 154, a lower wall 156 and a base wall 158 connecting the upper wall to the lower wall. The upper wall 154 and the lower wall 156 can contact the lower boss 126 on the plate 120 to limit the vertical movement of the handle grip stem 70. The handle grip stem 170 can also include other formations to control the vertical movement of the handle grip stem inside of the upper handle 40. For example, a post can be fastened to the external wall 48 below the handle grip stem. It is noted that the notches 142 and 152 allow for longer fasteners 58 and 62 to be used to fasten the plate 120 to the upper handle 40, while maintaining a compact design for the upper handle.

Figure 5:
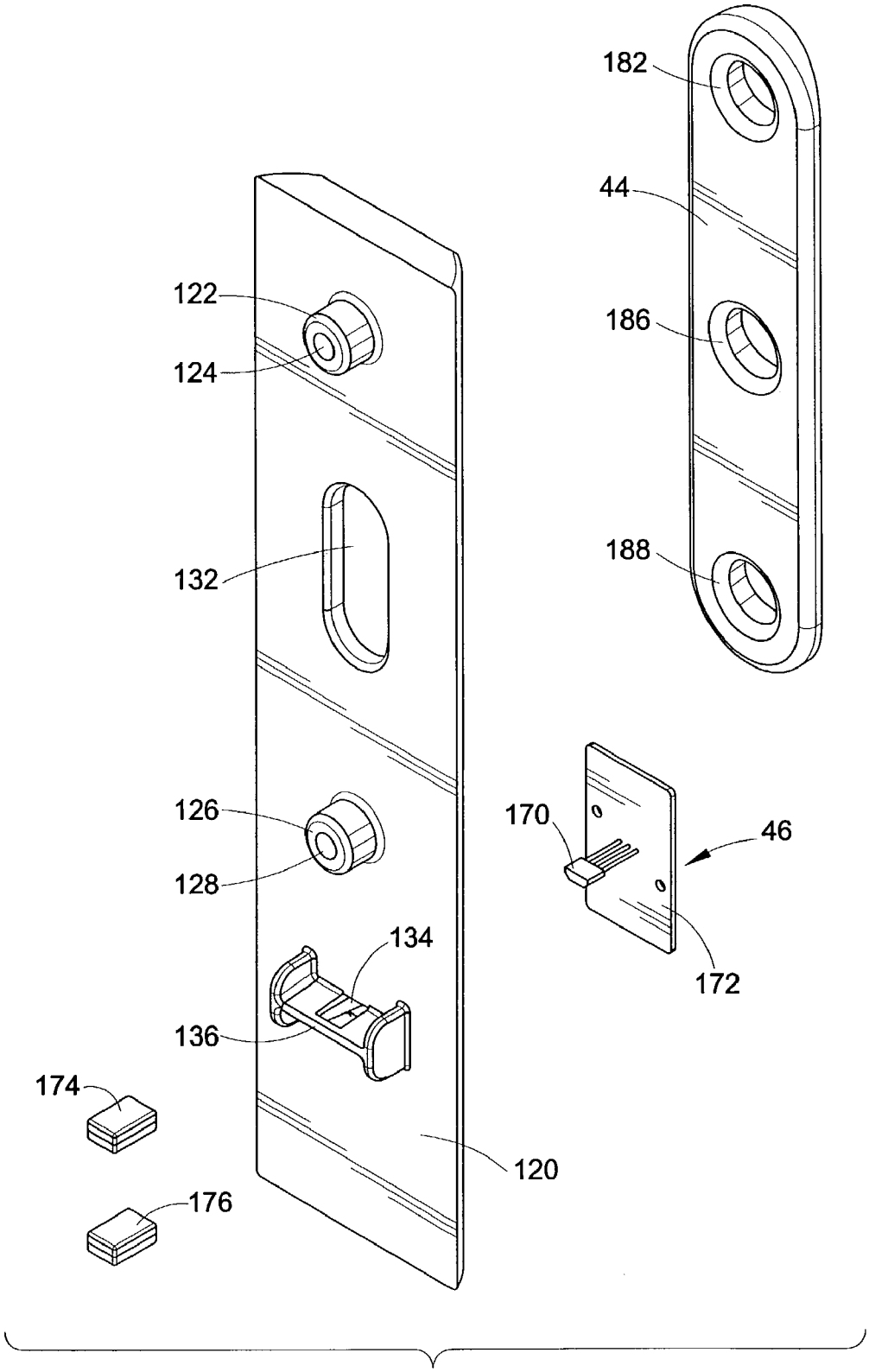
FIG. 5 is an enlarged exploded perspective view of a neutral return spring, a sensor assembly and a plate of FIG. 2.

The handle grip stem 70 further includes a sensor notch 162 disposed below the lower notch 152 having an upper wall 164, a lower wall 166 and a base wall 168 connecting the upper wall to the lower wall. The sensor notch 162 receives a portion of the sensor assembly 46. The sensor assembly 46 includes a Hall effect probe 170 mounted to a circuit board 172. The circuit board 172 is mounted to the plate 120 such that the Hall effect probe 170 protrudes through the sensor opening 134 (FIG. 5) into the sensor notch 162. The Hall effect probe detects the presence of a magnetic field. To this end, an upper magnet 174 mounts to the upper wall 164 of the sensor notch 162 and a lower magnet 176 mounts to the lower wall 166 of the sensor notch.

Since the magnets 174 and 176 are mounted to the handle stem 70, as the handle stem is moved downward by the operator the upper magnet 174 moves closer toward the Hall effect probe 170, which in turn communicates through conventional wiring (not shown) with the motor 26 to rotate the motor in a forward direction. Furthermore, the closer the upper magnet 174 moves towards the Hall effect probe 170, the more power is delivered to the motor 26. As the operator releases the force from the handle 68, the neutral return spring 44 urges the post 114 upward, thus moving the upper magnet 174 away from the Hall effect probe 170. When the Hall effect probe 170 is positioned equidistant between the upper magnet 174 and the lower magnet 176, the Hall effect probe communicates with the motor 26 such that the motor is ordered to stop turning. Likewise, when the operator pulls on the handle 68, the lower magnet 176 moves toward the Hall effect probe 170. Now, the Hall effect probe communicates with the motor 26 to direct the motor to drive in a reverse rotation. The power delivered to the motor 26 is also a function of the distance between the lower magnet 176 and the Hall effect probe 170. After removal of the force by the operator, the neutral return spring 44 urges the post 114 of the handle stem 70 downward toward the neutral position.

Even though one type of sensor and sensor assembly has been disclosed, the invention contemplates many other types of sensor assemblies, including but not limited to a potentiometer, an optical position sensor, a capacitive position sensor, a piezoelectric position sensor, or any known suitable sensing apparatus. Furthermore, the invention is not limited to the orientation of the sensor assembly as described. For example, the Hall effect probe 170, or any known sensor, can mount to a movable portion of the handle assembly 22 while the elements that it senses can be fixedly attached to the handle assembly.

As shown in FIG. 3, the neutral return spring 44 is interposed between the plate 120 and the external wall 48 of the upper handle 40. With reference again to FIG. 2, the neutral return spring 44 can have an elliptical, oval or racetrack configuration. In cross-section, the neutral return spring 44 can have a rectangular configuration as illustrated in FIG. 3. It should be appreciated that the neutral return spring 44 could have other configurations, including, for example, a dog-bone shape. Also, the neutral return spring could be hollow.

With continued reference to FIG. 2, the neutral return spring 44 includes an upper opening 182 that receives the upper boss 122 of the plate 120. The upper opening 182 is dimensioned to allow a friction fit between the boss 122 and the upper opening to mount the neutral return spring 44 to the plate 120. The neutral return spring 44 also includes a lower opening 184 that receives the lower boss 126 of the plate 120. The lower opening 184 is dimensioned to allow a friction fit between the projection 126 and the lower opening to mount the neutral return spring 44 to the plate 120.

A central opening 186 of the neutral return spring 44 receives the post 114 of the handle grip stem 70. The central opening 186 is dimensioned to allow a friction fit between the post 114 and the central opening. As more clearly seen in FIG. 3, the neutral return spring is rigidly mounted between the plate 120 and the external wall 48 of the upper handle 40. The post 114 slides in the notch 132 of the plate 120, and the neutral return spring 44 biases the post toward a central position when the force that moves the post as been removed.

Although the neutral return spring has been described as being mounted to the plate 120, it could mount directly to the external wall 48 of the upper handle 40 if so desired. Also, the neutral return spring 44 can mount directly to the handle grip stem 70 and a rigidly fastened post (not shown) can be mounted to the external wall 48 of the upper handle. In this embodiment, the bosses 122 and 126 of the plate are rigidly fastened to the handle external wall 48, and the connection between the neutral return spring and the handle grip stem 70 is provided by the post 114.

Preferably, the neutral return spring 44 is made of a plastic or polymer material exhibiting inherent damping characteristics. Constructing the neutral return spring of a polymer reduces the possibility of overshoot. Such overshoot occurs when, after removing a pushing or pulling force on the handle 68, the sensor assembly moves past the neutral position, due to the natural periodic motion of the spring, moving the magnets 174 and 176 closer to and farther from the Hall effect probe 170 as the spring returns to equilibrium. This can result in the motor 26 being quickly directed to change from a forward rotation to a backward rotation, and back again, instead of simply stopping its rotation. Rapid reversals of rotational direction of the motor are undesirable and may harm the motor or the transmission coupled to the motor. They are also disconcerting to the user of the vacuum cleaner. It has been found that certain polymeric materials used as springs exhibit a dampening effect to mitigate any overshoot. One suitable material that exhibits such properties is a silicone rubber available from a large variety of vendors, including Advanced Elastomer Systems, Inc. of Akron, Ohio.

The material from which the neutral return spring 44 is made contributes to a critically damped or overdamped system between the handle assembly 22, the neutral return spring, and the upper handle 40. Also, the positioning of the neutral return spring 44 between the plate 120 and the external wall 48 of the upper handle 40 contributes to the dampening effect. Friction between the neutral return spring 44 and either the plate 120 or the external wall 48 results in an energy loss in the spring, which contributes to the dampening effect. Accordingly, the rectangular cross-section of the neutral return spring 44 (FIG. 3) allows for more surface area of the spring to contact either the plate 120 or the external wall 48, when compared to a helical spring, for example.

The following example is provided to facilitate the explanation of the invention but is not intended to limit the invention to the specific embodiments disclosed. The graph depicted in FIG. 8 was developed using the embodiment depicted in FIGS. 1–7, having a neutral return spring made from a silicone rubber. With reference to FIG. 8, the handle grip 68 was fully deflected to obtain a maximum speed request signal. The graph discloses a voltage signal delivered from the Hall effect sensor assembly 46 to the motor 26 as the handle grip 68 was released and allowed to return to the neutral position at the urging of the neutral return spring 44. As can be seen from the graph, when the neutral return spring 44 was fully deflected, the Hall effect sensor assembly 46 delivered a higher signal to the motor 26, as shown in the upper left portion of the curve. As the neutral return spring 44 returned to equilibrium, the Hall effect sensor assembly 46 transitioned to delivering a lower signal because the Hall effect probe 170 sensed less of a magnetic field as one of the magnets 174 or 176 traveled farther from the probe. When the neutral return spring 44 returned to equilibrium, as designated by the nearly linear lower right portion of the graph, the Hall effect sensor assembly 46 delivered a lower signal to the motor. If the system were an underdamped system, the lower left portion of the curve would exhibit oscillations, because the Hall effect probe 170 would be sensing an oscillating magnetic field as the handle stem 70 oscillated back and forth around a neutral point.

Although a polymeric neutral return spring 44 has been disclosed, the neutral return spring 44 can be made from other materials besides a polymer, including metal, a composite (e.g. a fiber reinforced resin), rubber or combinations thereof. Also other types of biasing members, including but not limited to, a helical spring, a disc spring, or any of a wide variety of other resilient members may also be suitable as long as they exhibit proper dampening effects and do not result in "ringing" as discussed above. The use of polymers is beneficial because the dampening effect of the spring can be changed according to the properties of the polymer and the geometry of the spring.

As stated above, the operator manipulates the handle assembly 22 to control the direction and speed of rotation of the motor 26. With reference now to FIG. 6, the drive motor 26 can be a brushless DC reversible motor. Accordingly, a rectifier (not shown) is positioned somewhere in the electronic circuitry to convert AC power from an external power source to DC power for the motor. Alternatively, the motor could run on AC power as well, thus obviating the need for a rectifier. The motor 26 drives a transmission 232, which in turn drives the wheels 28 and 30. The motor 26 can be a direct drive motor, thus eliminating the need for a clutch in the transmission to reverse the direction of rotation of the transmission. If desired, the motor could drive only one wheel or more than two wheels.

While the neutral return spring 44 is shown as being mounted to the handle 40 and engages the handle grip 42, the mounting arrangement could be reversed. In other words, the neutral return spring could instead be mounted to the handle grip and engage the handle, if so desired. Furthermore, more than one neutral return spring can be provided.

Figure 9:
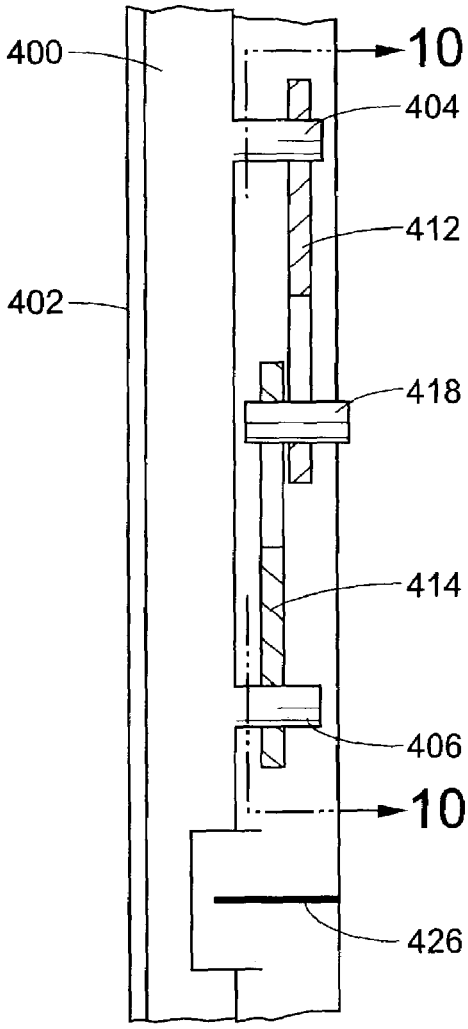
FIG. 9 is an assembled side cross-sectional elevation view of an alternate handle assembly of FIG. 3.
Figure 10:
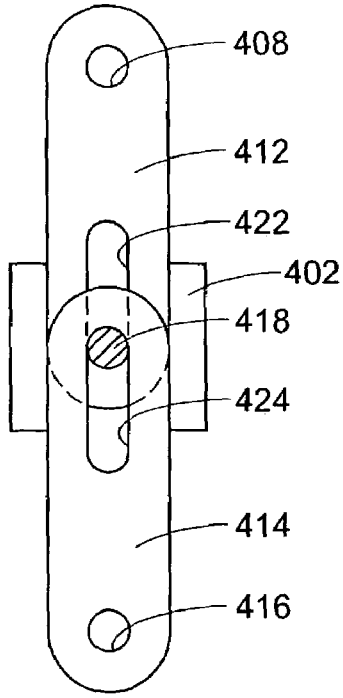
FIG. 10 is an enlarged side cross-sectional view of the handle assembly of FIG. 9 taken along line 10—10 not showing a handle grip stem.

With reference to FIG. 9, an alternate embodiment of an upper handle assembly is there shown. In this embodiment, a handle grip stem 400 is received inside an upper handle 402. The handle grip stem 400 includes an upper post 404 and a lower post 406. With reference also now to FIG. 10, the upper post 404 can be received in an aperture 408 of an upper neutral return spring 412. The lower post 406 can be received in an aperture 416 of a lower neutral return spring 414. The upper handle 402 includes a post 418, which can include a rivet, a screw or similar projection, that is received by the upper neutral return spring 412 in a slot 422 and by the lower post 418, which can include a rivet, a screw or similar projection, that is received by the upper neutral return spring 412 in a slot 422 and by the lower neutral return spring 414 in a slot 424.

By providing two separate neutral return springs 412 and 414, separate characteristics such as dampening or stiffness for each spring can be provided. For example, the upper neutral return spring 412 can be made from a stiffer material than the lower neutral return spring 414, and vice versa. Accordingly, a different amount of force in either a pushing or pulling direction can result in the same amount of displacement of the handle grip stem 402 with respect to a Hall effect sensor 426.

Figure 11:
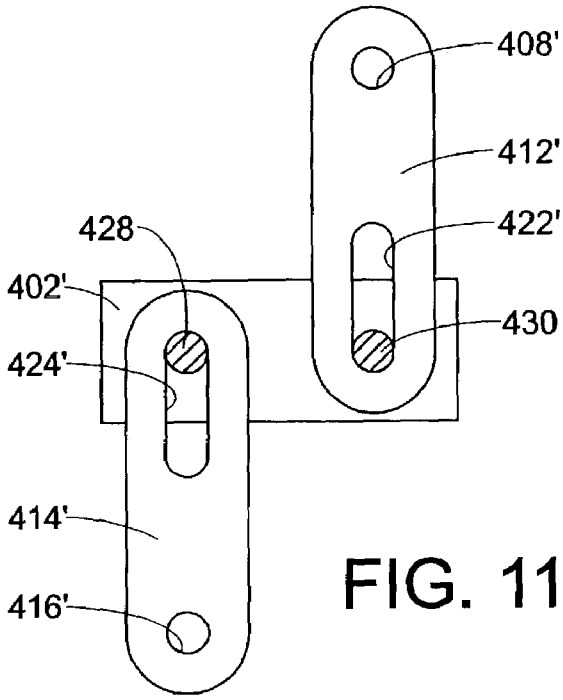
FIG. 11 is an enlarged view of an alternate embodiment of the handle assembly of FIG. 10.

With reference now to FIG. 11, another alternate embodiment of an upper handle assembly is there shown. For ease of illustration and comprehension, like components are designated with like numerals having a primed (') suffix and new components are designated with new numerals. In this embodiment, an upper handle 402' includes a first post 428 and a second post 430 spaced from the first post. The posts 428 and 430 are similar in configuration to the post 418 described above with reference to FIGS. 9 and 10.

The first post 428 is received in a slot 424' in a lower neutral return spring 414'. The second post 430 is received in a slot 422' in an upper neutral return spring 412'. The upper neutral return spring 412' also includes an opening 408' to receive a portion of the handle grip stem (not shown). Likewise, the lower neutral return spring 414' also includes an opening 416' to receive a portion of the handle grip stem (not shown).

Even though FIGS. 9–11 show two separate neutral return springs fastened in such a way that the post 418 or posts 428 and 430 attach to the stationary upper handle 400, however other alternatives are contemplated by the invention. For example only one neutral return spring can be used, which is similar to FIGS. 1–5, while being mounted similar to FIGS. 9–11. Furthermore, two or even a plurality of neutral return springs could be mounted similar to that described with reference to FIGS. 1–5.

Figure 7:
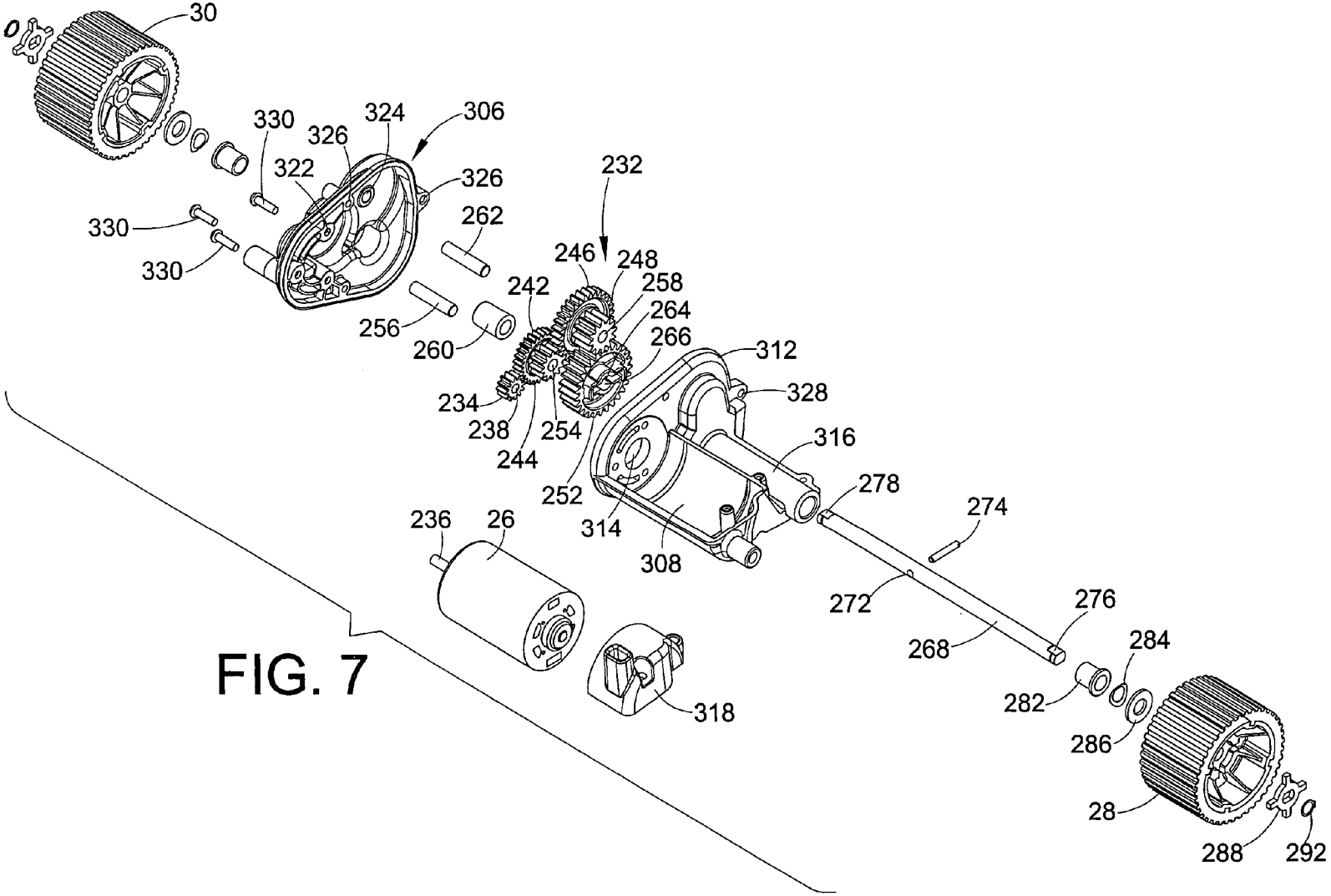
FIG. 7 is an exploded perspective view of a drive motor and transmission assembly of the vacuum cleaner of FIG. 1.
Figure 8:
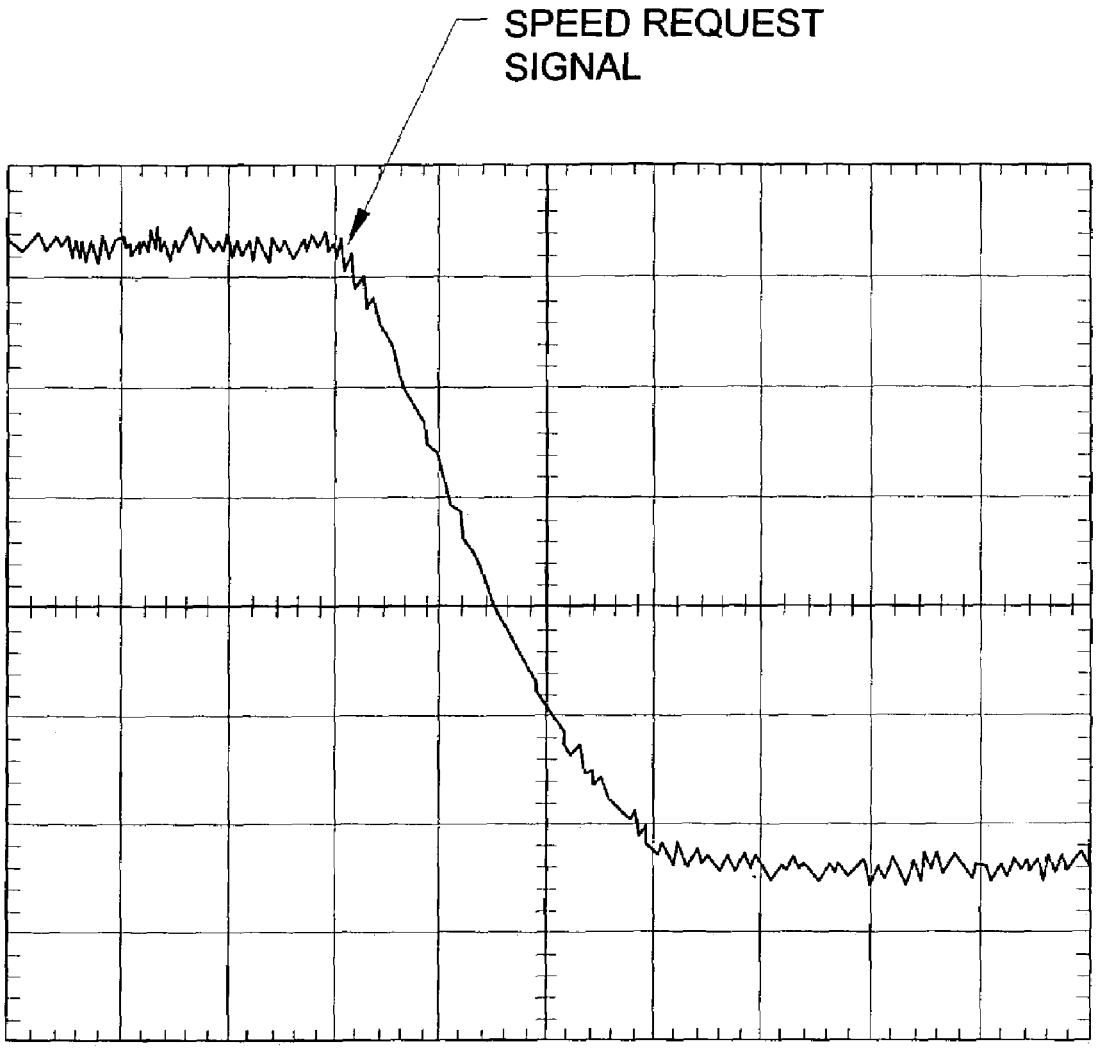
FIG. 8 is a graph of the signal sent from a sensor located in the handle assembly to the drive motor of the vacuum cleaner of FIG. 1.

With reference now to FIG. 7, the transmission 232 includes a pinion gear 234 driven by an output shaft 236 of the motor 26. The output shaft 236 is received in an opening 238 in the pinion gear 234. The pinion gear 234 drives a first gear 242. The first gear 242 includes toothed extension 244. The extension 244 intermeshes with and drives an intermediate gear 246. The intermediate gear 246 includes an extension 248. The extension 248 intermeshes with and drives a sprocket 252. The first gear 242 and the extension 244 include an opening 254 to receive a first gear shaft 256. The intermediate gear 246 and the extension 248 include an opening 258 to receive a second gear shaft 262. A gear spacer 260 is positioned between the first gear 242 and its housing (described below). The sprocket 252 includes and opening 264 having a keyed notch 266. The opening 264 receives an axle 268. The axle 268 includes an opening 272 to receive a pin 274. The pin 274 is received in the keyed notch 266 to lock the axle 268 to the sprocket 252. Accordingly, as the sprocket 252 rotates it turns the axle 268 which has the driven wheels 28 and 30 mounted to its ends. Although a specific type of transmission has been described, the invention encompasses many different types of transmissions.

The axle 268 includes a first squared portion 276 that is received in an axle opening in the first wheel 28 and a second squared portion 278 that is received in an axle opening in the second wheel 30. A bearing 282, a curved washer 284, and a washer 286 (only referenced on one end of the axle) are received on the axle 268. A wheel lock 288 and a retainer ring 292 (only referenced on one end of the axle) are received on the squared portion 276 to fasten the wheel 28 to the axle. Although a specific type of connection between the wheels 28 and 30 and the axle 268 has been disclosed, the invention encompasses any type of such connection as is generally known in the art.

The transmission 232 is housed in a transmission housing 302 (FIG. 6). The transmission housing 302 includes a first half 304 and a second half 306 of a clamshell type housing. The first half 304 includes a well 308 to receive the motor 26. The well abuts a wall 312 on one end. The wall 312 has an opening 314 through which protrudes the output shaft 236 of the motor 26. The first half 304 of the housing also includes an axle housing 316, which comprises a hollow cylinder, to receive the axle 268. A motor cover 318 mounts over the well 308 to cover a portion of the motor 26 when it is placed in the well.

The second half 306 also includes an axle housing 320 to receive the axle 268. The second half 306 includes a first shaft opening 322 to receive the gear shaft 256 of the first gear 242 and an intermediate shaft opening 324 to receive the gear shaft 262 of the intermediate gear 246. The second half also includes openings 326 that align with openings 328 on the first half 304 to receive conventional fasteners 330 to attach the first half to the second half.

Referring to FIG. 6, the base 12 includes a cover 340 to house a brushroll (not shown). A circuit board 342 is mounted to the base 12 and is electronically connected to the sensor assembly 46, described above. The sensor assembly 46, which could also be termed a detector assembly, delivers a signal to the circuit board 342, which translates the signal to control the direction of rotation and the speed of the motor 26.

The circuit board 342 can include various circuits to treat the electrical signal sent to the motor 26. Such circuits are disclosed in copending applications entitled Control Circuitry for Enabling Drive System for Vacuum Cleaner, Ser. No. 10/339,097, and Electronically Commutated Drive System for a Vacuum Cleaner, Ser. No. 10/339,122 which are being filed simultaneously and herewith. The subject and matter of each of those applications is incorporated hereinto, in its entirety.

The drive motor 26 can be moved in relation to the nozzle base 12 as disclosed in a copending application entitled Clutchless Self-Propelled Vacuum Cleaner and Nozzle Height Adjustment Mechanism Therefor, Ser. No. 10/339,191 which is being filed simultaneously herewith. That application is incorporated hereinto in its entirety.

While the preferred embodiment has been described with reference to such terms as "upper", "lower", "vertical", and the like, these terms are used for better understanding of the invention and with respect to the orientation of the vacuum and the surface to be cleaned. These terms do not limit the scope of the invention.

The invention has been described with reference to a preferred embodiment. Obviously, modifications and alterations will occur to others upon a reading and understanding the preceding detailed description. It is intended that the invention be construed as including all such modifications and alterations as so far as they come within the scope of the claims, and equivalents thereof.

What is claimed is:

1. A self propelled vacuum cleaner comprising:

a base having a suction inlet;

an upright housing pivotally mounted on said base;

a suction source disposed in one of said base and said upright housing to generate an airflow at said suction inlet;

a filter chamber mounted in one of said base and said upright housing and in communication with said suction inlet and said suction source;

a drive motor mounted to one of said base and said upright housing;

a driven wheel operatively connected to said drive motor to propel said base; and a handle assembly mounted to said upright housing, wherein said handle assembly comprises:

an upper handle, a handle grip assembly slidably mounted on said upper handle, a neutral return spring fastened to one of said upper handle and said handle grip assembly and engaging another of said upper handle and said handle grip assembly to urge said handle grip assembly to a neutral position, and a handle position sensor assembly, comprising a Hall sensor electronically connected to said drive motor, wherein said handle position sensor assembly is configured to communicate with said drive motor to control delivery of proportionally varying amounts of power to said drive motor.

2. The vacuum cleaner of claim 1, wherein said handle position sensor assembly is electronically connected to said drive motor to control a direction in which said drive motor drives said driven wheel.

3. The vacuum cleaner of claim 2, wherein said handle position sensor assembly includes a detector mounted adjacent said upper handle and at least one magnet mounted adjacent said handle assembly, wherein one of said detector and magnet is rigidly mounted and the other of said detector and magnet is movably mounted.

4. The vacuum cleaner of claim 1, wherein said handle grip assembly includes a handle grip slidably mounted to at least partially surround a portion of said upper handle and a handle grip frame attached to said handle grip, wherein at least a portion of said handle grip frame is positioned inside said upper handle.

5. The vacuum cleaner of claim 1, wherein said handle assembly further comprises an upper handle plate interposed between said handle grip assembly and said neutral return spring.

6. The vacuum cleaner of claim 5, wherein said upper handle plate includes a slot to receive a portion of said handle grip assembly that engages said neutral return spring.

7. The vacuum cleaner of claim 6, wherein said upper handle plate includes a first projection positioned above said slot and a second projection positioned below said slot, wherein said projections engage said neutral return spring.

8. The vacuum cleaner of claim 7, wherein each of said projections defines an opening to receive a fastener to attach said upper handle to said upper handle plate.

9. The vacuum cleaner of claim 8, wherein said neutral return spring includes a first aperture to receive said first projection and a second aperture to receive said second projection.

10. The vacuum cleaner of claim 9, wherein said neutral return spring includes a central aperture positioned between said first aperture and said second aperture to receive said portion of said handle grip assembly.

11. The vacuum cleaner of claim 1, wherein said neutral return spring comprises a single piece of elastomeric material.

12. The vacuum cleaner of claim 11, wherein said neutral return spring comprises a polymer.

13. The vacuum cleaner of claim 1, wherein said neutral return spring includes a first opening to receive a fastener for mounting said neutral return spring to said upper handle and a second opening to receive a portion of said handle grip assembly for mounting said neutral return spring to said handle grip assembly.

14. The vacuum cleaner of claim 1, wherein said handle assembly includes a stop wall to limit the movement of said handle grip assembly in relation to said upper handle.

15. The vacuum cleaner of claim 1, further comprising a sensor, wherein said handle grip assembly defines a notch having a locating wall, said notch receives said sensor, wherein said sensor communicates with said drive motor as a function of a distance between said locating wall and said sensor.

16. The vacuum cleaner of claim 1, wherein said neutral return spring comprises a first elastic member fastened to said handle grip assembly and said upper handle, and further comprising a second elastic member fastened to said handle grip assembly and said upper handle.

17. The vacuum cleaner of claim 16 wherein said first elastic member has a first stiffness and said second elastic member has a second stiffness, which is greater than the first stiffness.

18. The vacuum cleaner of claim 1, wherein the amount of power delivered to said drive motor is a function of a location of said handle grip assembly with respect to said upper handle.

19. A self propelled vacuum cleaner comprising:

a base having a suction inlet;

a handle pivotally mounted to said base;

a suction source disposed in one of said base and said handle to generate an airflow at said suction inlet;

a filter chamber mounted to one of said base and said handle and in communication with said suction inlet and said suction source;

a drive motor mounted to one of said base and said handle;

a driven wheel operatively connected to said drive motor;

a handle grip mounted for reciprocation in relation to said handle between a first end position, a neutral position and a second, opposite, end position;

a stem extending from said handle grip, said stem including a projection;

a neutral return spring mounted to said handle and receiving at least a portion of said projection, said neutral return spring urging said handle grip to the neutral center position; and a plate mounted to said handle, wherein said neutral return spring is mounted adjacent said plate.

20. The vacuum cleaner of claim 19, wherein said neutral return spring is sandwiched between said plate and a wall of said handle.

21. The vacuum cleaner of claim 19, wherein said plate includes a slot to receive said projection, said slot having a width slightly larger than said projection of said handle stem to limit lateral movement of said handle stem, and wherein said slot having a length sized to allow said projection to move along the length of said slot.

22. The vacuum cleaner of claim 19, wherein said plate includes a projection substantially normal to a plane of said plate, said projection having a wall defining an opening, wherein an outer surface of said projection is received by an aperture in said neutral return spring and said opening in said projection receives a fastener to attach said plate to said handle.

23. The vacuum cleaner of claim 19, wherein said handle grip stem includes a notch to receive a portion of said plate, wherein said notch includes walls to limit movement of said handle grip stem in relation to said handle.

24. The vacuum cleaner of claim 19, wherein said neutral return spring comprises a polymer material.

25. A self propelled vacuum cleaner comprising:

a base having a suction inlet;

a handle pivotally connected to said base;

a suction source mounted to one of said base and said handle to generate an airflow at said suction inlet;

a filter chamber mounted in one of said base and said handle and in communication with said suction inlet and said suction source;

a drive motor mounted to one of said base and said handle;

a driven wheel operatively connected to said drive motor;

a handle grip slidably mounted on said handle;

a handle stem connected to said handle grip and including a post, wherein at least a portion of said handle stem is received in said handle;

a plate;

a fastener for attaching said plate to said handle; and an elastomeric biasing member mounted to said plate and mounted to said handle, wherein said biasing member urges said handle grip toward a neutral position upon displacement of said handle grip in relation to said handle from the neutral position.

26. The vacuum cleaner of claim 25, further comprising a detector assembly mounted in said handle, wherein said detector assembly is in communication with said drive motor to control a direction in which said drive motor drives said driven wheel.

27. The vacuum cleaner of claim 25, further comprising a sensor mounted adjacent said upper handle, said sensor being in communication with said drive motor.

28. The vacuum cleaner of claim 27, wherein said handle grip stem includes a sensor notch having a first wall and a second wall spaced from said first wall, wherein said sensor is mounted between said first wall and said second wall.

29. The vacuum cleaner of claim 28, wherein said sensor comprises a Hall effect probe.

30. The vacuum cleaner of claim 29, wherein a first magnet is mounted to said first wall and a second magnet is mounted to said second wall, wherein said Hall effect probe is disposed in said notch such that said Hall effect probe senses the presence of a magnetic field.

* * * * *